US007852224B1

(12) United States Patent
Keehn, Sr. et al.

(10) Patent No.: US 7,852,224 B1
(45) Date of Patent: Dec. 14, 2010

(54) DOOR ANNOUNCEMENT SYSTEM

(76) Inventors: Donn A. Keehn, Sr., 1910 Colonial Pkwy. NE., Massillon, OH (US) 44646; Randall S. Wilhelm, 3374 Harris Ave. NW., Canton, OH (US) 44708

( * ) Notice: Subject to any disclaimer, the term of this patent is extended or adjusted under 35 U.S.C. 154(b) by 267 days.

(21) Appl. No.: 11/971,729

(22) Filed: Jan. 9, 2008

(51) Int. Cl.
*G08B 23/00* (2006.01)

(52) U.S. Cl. ..... 340/573.1; 340/572.1; 340/573.2; 340/573.3; 340/665; 340/666; 200/85 R; 200/86.5; 367/197

(58) Field of Classification Search ..... 340/573.1, 340/665, 666, 567, 326–332, 691, 521, 539.1, 340/539.12, 539.14; 160/179, 180, 181; 307/116, 119; 367/197; 200/85 R, 86.5; 119/61, 175, 707, 712, 719, 720
See application file for complete search history.

(56) References Cited

U.S. PATENT DOCUMENTS 3,566,390 A 2/1971 Zevas et al.
3,991,415 A 11/1976 Baar, Sr.
4,924,214 A * 5/1990 Hill ..... 340/666
D352,630 S 11/1994 Yamanaka
5,604,478 A 2/1997 Grady et al.
5,673,022 A * 9/1997 Patel ..... 340/565
6,445,302 B2 9/2002 Vena
2004/0095254 A1 5/2004 Maruszczak
2005/0252622 A1* 11/2005 Reid ..... 160/180

* cited by examiner

*Primary Examiner*—Benjamin C Lee
*Assistant Examiner*—Sisay Yacob

(57) ABSTRACT

A door announcement system for indicating the presence of a person or on animal outside a door includes at least one transmitting assembly sending an indicator signal when the at least one transmitting assembly is actuated. At least one receiving assembly engages an electrical outlet to provide power to the at least one receiving assembly. The at least one receiving assembly is in electrical communication with a lamp to turn the lamp on and off when the at least one receiving assembly receives the indicator signal.

14 Claims, 7 Drawing Sheets

DOOR ANNOUNCEMENT SYSTEM

BACKGROUND OF THE INVENTION

1. Field of the Invention

The present invention relates to door bell answering systems and more particularly pertains to a new door bell answering system for indicating the presence of a person or on animal outside a door.

2. Description of the Prior Art

The use of door bell answering systems is known in the prior art. While these devices fulfill their respective, particular objectives and requirements, the need remains for a system that has certain improved features allowing for a receiving assembly to be plugged into an outlet between the outlet and a lamp to allow the lamp to be flashed to signal the presence of a person outside a door wirelessly. Additionally, the system may include a transmitting assembly that can be attached to a pet to indicate when a pet is at the door.

SUMMARY OF THE INVENTION

The present invention meets the needs presented above by generally comprising at least one transmitting assembly sending an indicator signal when the at least one transmitting assembly is actuated. At least one receiving assembly engages an electrical outlet to provide power to the at least one receiving assembly. The at least one receiving assembly is in electrical communication with a lamp to turn the lamp on and off when the at least one receiving assembly receives the indicator signal.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
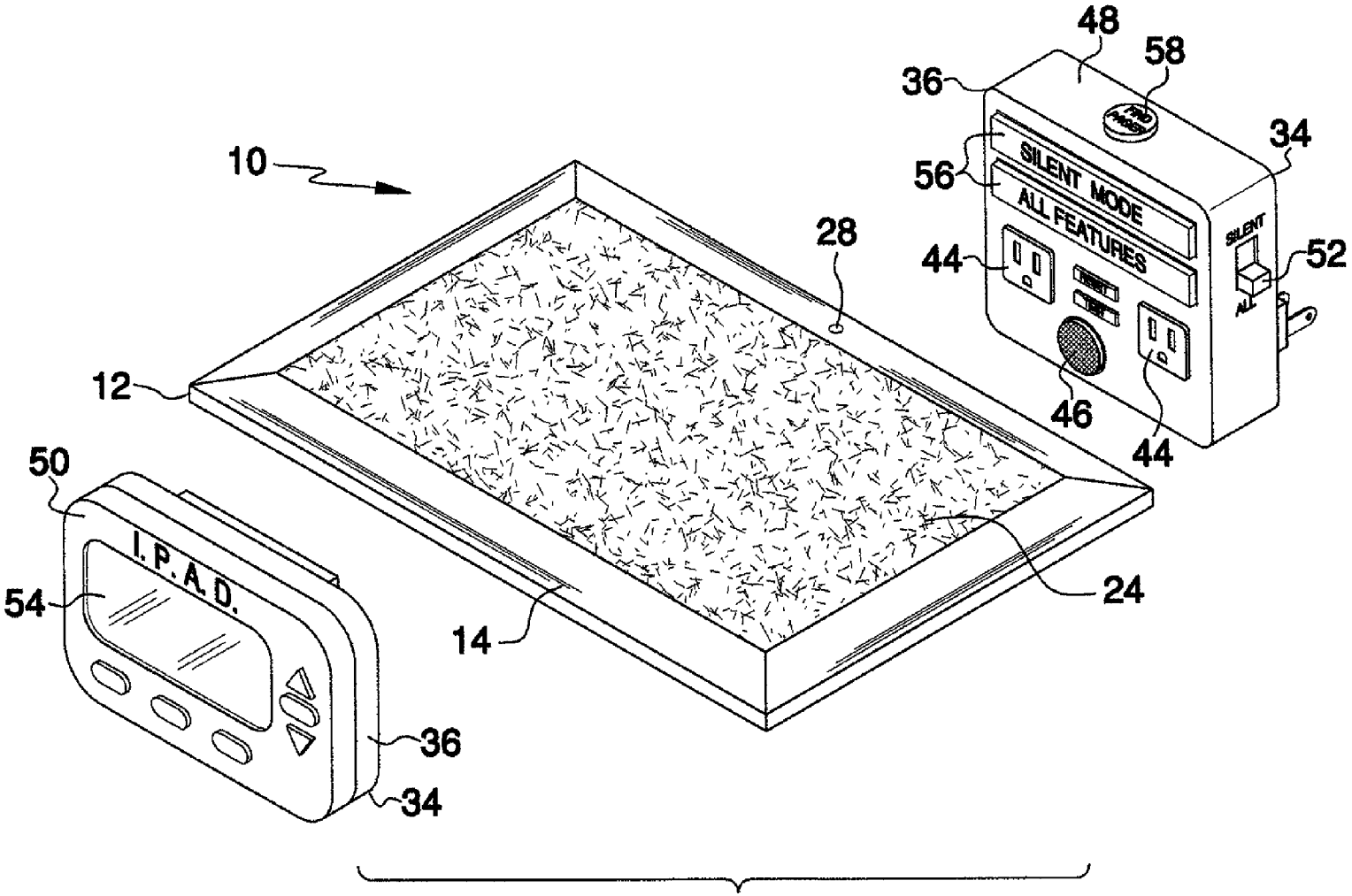
FIG. 1 is a perspective view of a door announcement system according to the present invention.
Figure 2:
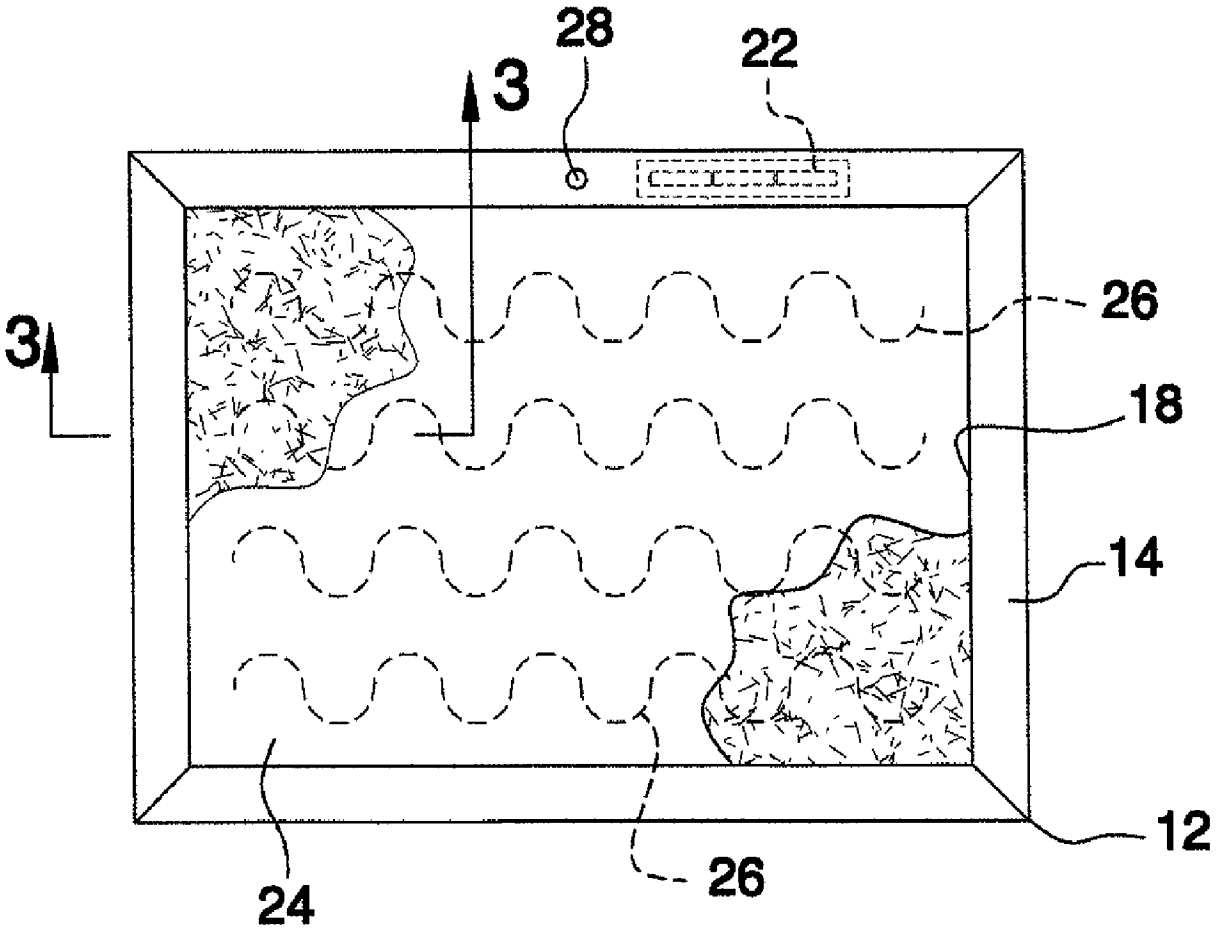
FIG. 2 is a top view of the transmitting assembly of the present invention.
Figure 3:
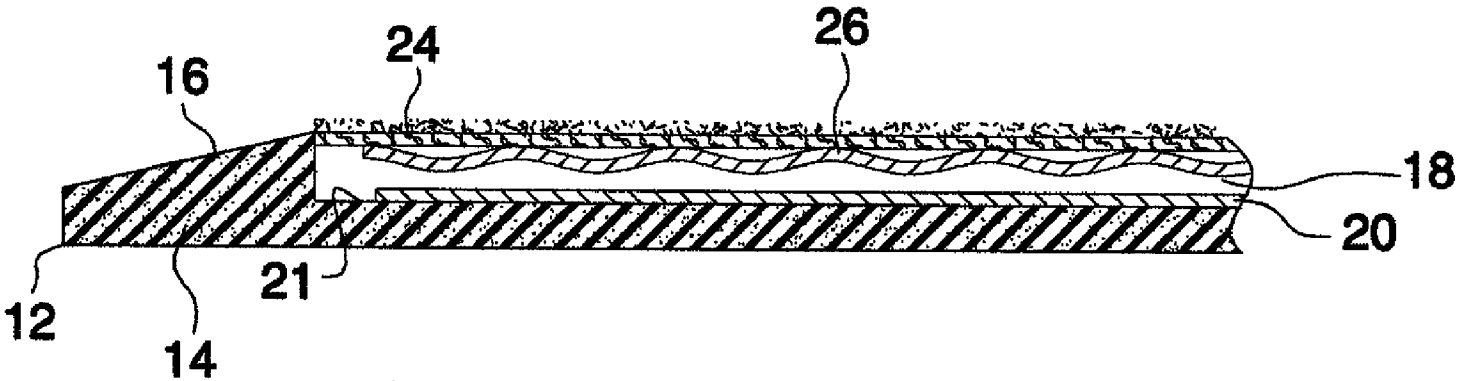
FIG. 3 is a cross-sectional view of the transmitting assembly of the present invention taken along line 3-3 of FIG. 2.
Figure 4:
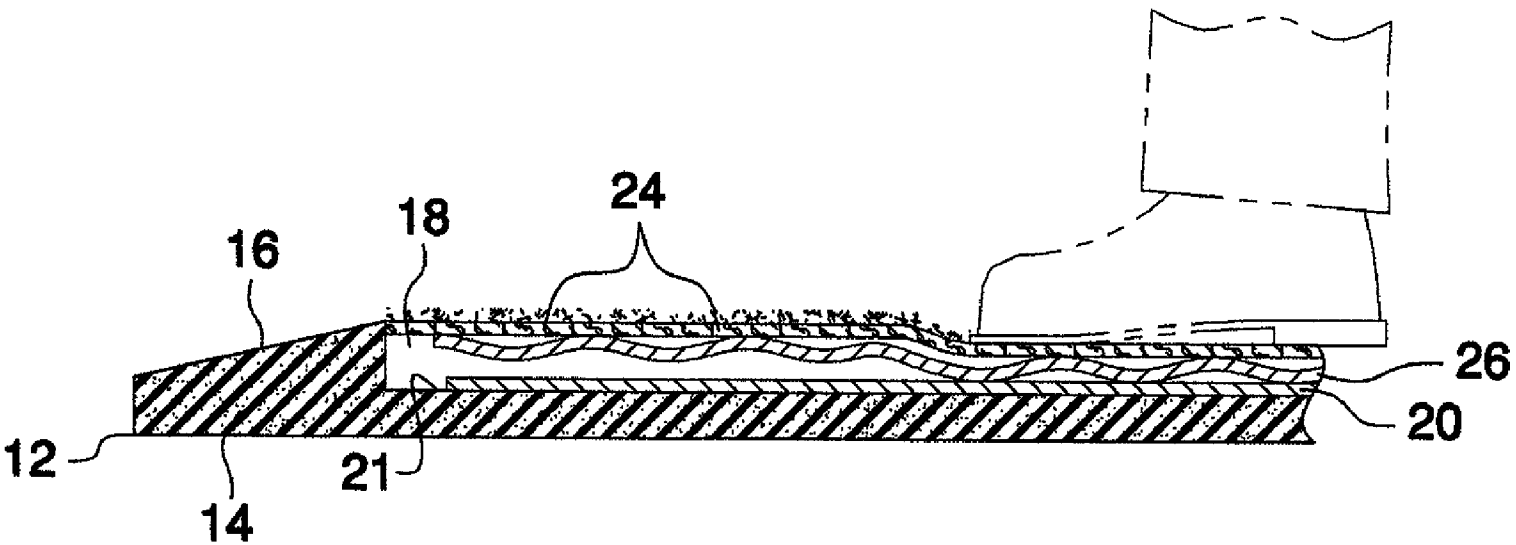
FIG. 4 is the cross-sectional view of the present invention shown in FIG. 3 with weight applied to the mat.
Figure 5:
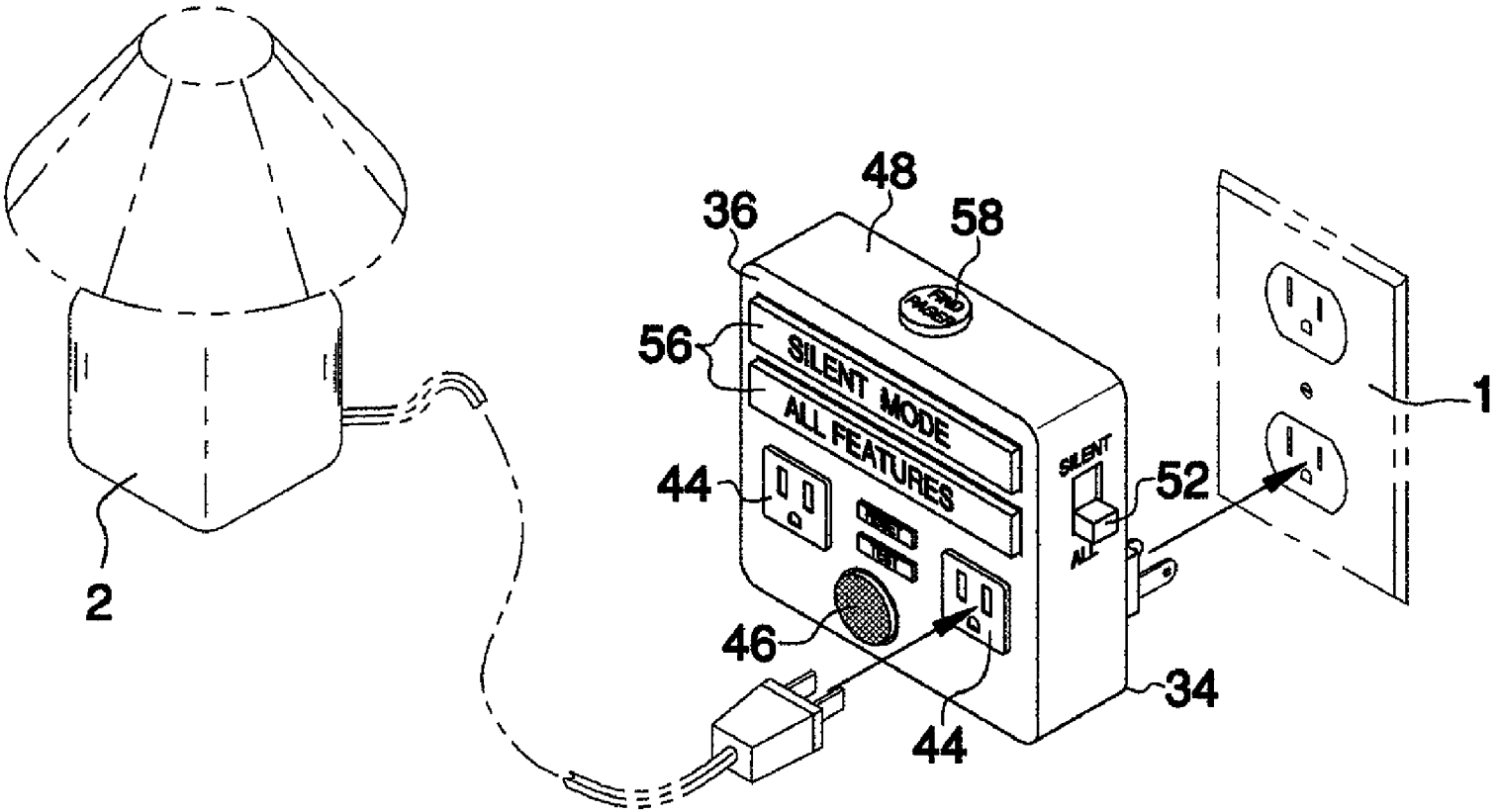
FIG. 5 is a perspective view of the receiving assembly of the present invention shown in use with lamp.

With reference now to the drawings, and in particular to FIGS. 1 through 8 thereof, a new door bell answering system embodying the principles and concepts of the present invention and generally designated by the reference numeral 10 will be described.

As best illustrated in FIGS. 1 through 8, the door announcement system 10 generally comprises at least one transmitting assembly 12 sending an indicator signal when the at least one transmitting assembly 12 is actuated. The at least one transmitting assembly 12 includes a frame 14 positioned on a support surface adjacent to a door. The frame 14 has an upper surface 16 having a depression 18 therein. A lower contact strip 20 is coupled to the frame 14. The lower contact strip 20 is positioned in the depression 18 along a bottom face 21 of the depression 18. The lower contact strip 20 is in electrical communication with a power supply 22 positioned in the frame 14.

The at least one transmitting assembly 12 additionally includes a mat 24 coupled to the frame 14 and extending across the depression 18 of the frame 14. The mat 24 is positioned adjacent to the upper surface 16 of the frame 14. The mat 24 is comprised of a flexible and fluid impermeable material to inhibit liquid entering the depression 18. The mat 24 flexes when weight is applied to the mat 24. The mat 24 returns to its original configuration when the weight has been removed from the mat 24.

The at least one transmitting assembly 12 also includes at least one upper contact strip 26 coupled to the mat 24 and positioned in the depression 18 of the frame 14. The at least one upper contact strip 26 is positioned in a spaced relationship to the lower contact strip 20 when the mat 24 is in its original configuration. The at least one upper contact strip 26 is in electrical communication with the power supply 22. The at least one upper contact strip 26 contacts the lower contact strip 20 when weight is applied to the mat 24 to complete an electrical circuit. A transmitter 28 is coupled to the frame 14. The transmitter 28 is in electrical communication between the lower contact strip 20 and the power supply 22. The transmitter 28 wirelessly transmits the indicator signal when the at least one upper contact strip 26 contacts the lower contact strip 20 to complete the electrical circuit.

Figure 6:
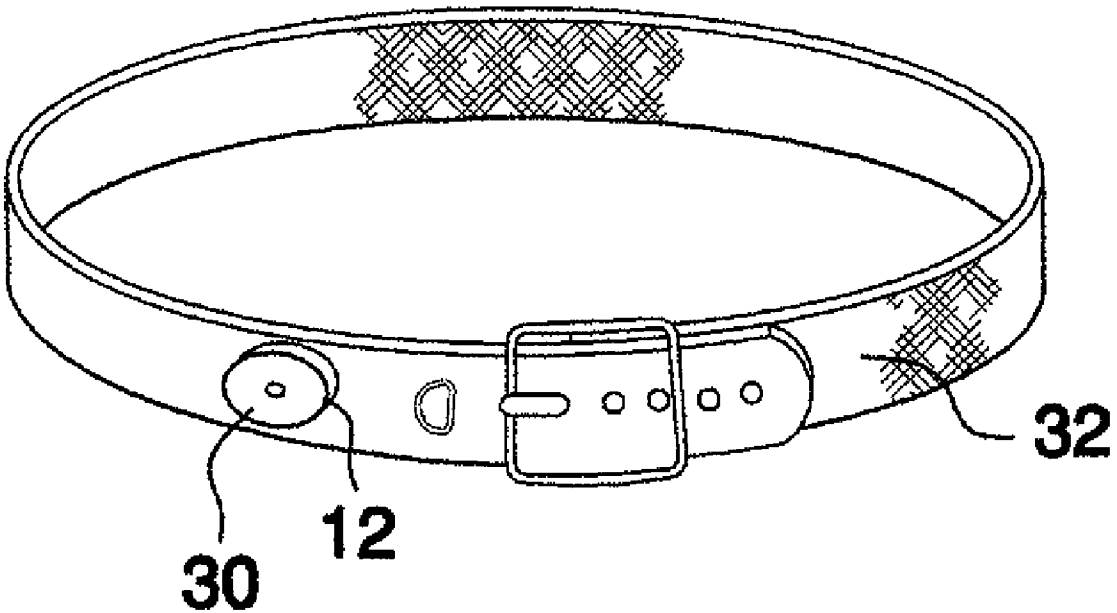
FIG. 6 is a perspective view of an embodiment of the transmitting assembly of the present invention.
Figure 7:
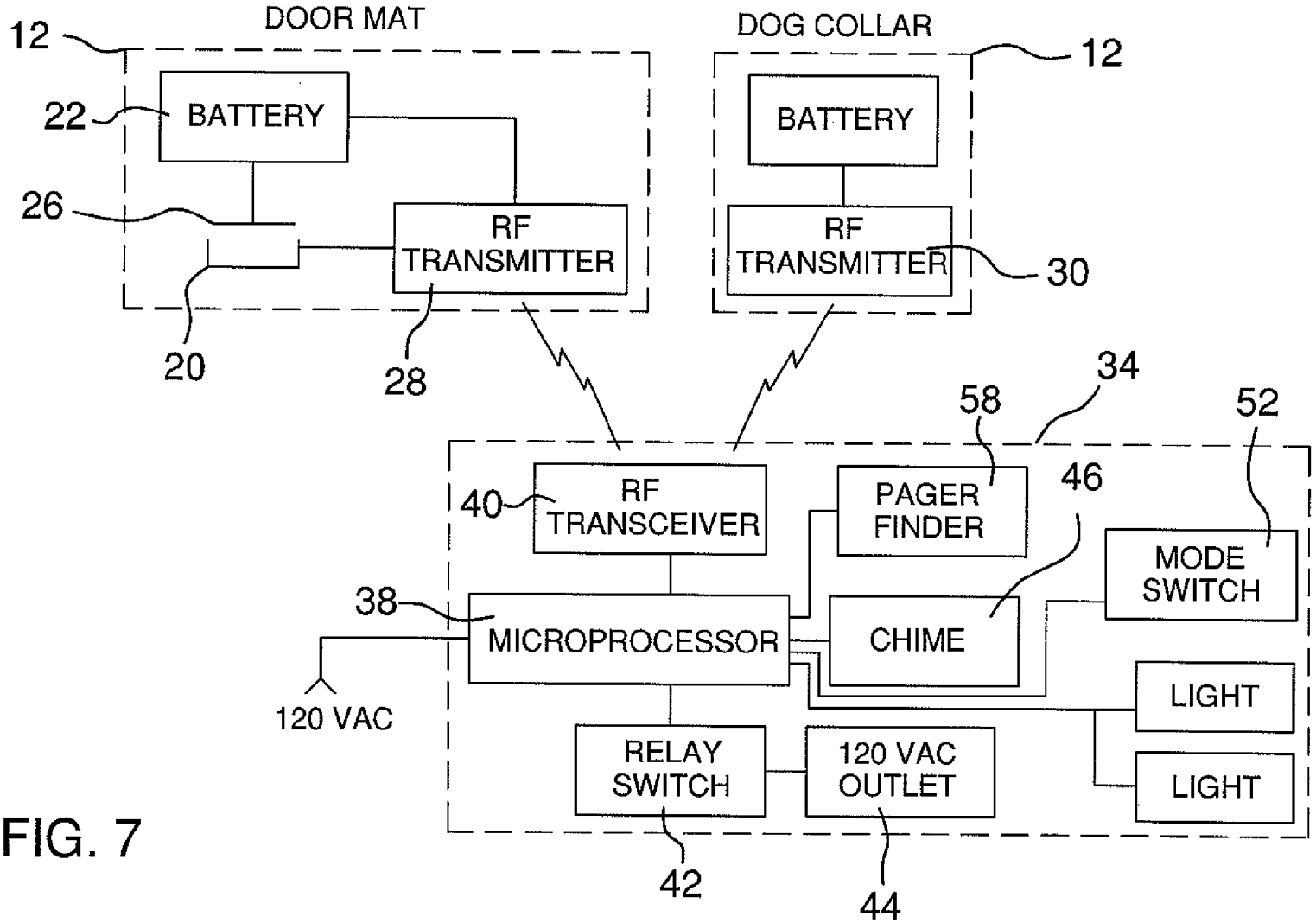
FIG. 7 is a schematic view of the present invention showing multiple transmitting assemblies being used with the receiving assembly.

In an embodiment, as shown in FIGS. 6 and 7, the at least one transmitting assembly 12 may include a proximity transmitter 30 coupled to a collar 32 positioned around a neck of an animal. The proximity transmitter 30 transmits the indicator signal over a limited range, such as less than 30 feet, wherein the indicator signal is received by the at least one receiving assembly 34 when the animal is positioned near the door. As shown in FIG. 7, the at least one transmitter 28 assembly may include a plurality of transmitters 28 that can be used in conjunction with each other to allow several doors and several animals, or any combination thereof, to be monitored at the same time.

At least one receiving assembly 34 engages an electrical outlet 1 to provide power to the at least one receiving assembly 34. The at least one receiving assembly 34 is in electrical communication with a lamp 2 to turn the lamp 2 on and off when the at least one receiving assembly 34 receives the indicator signal. The at least one receiving assembly 34 includes a case 36 housing a microprocessor 38. The microprocessor 38 is in electrical communication with the electrical outlet 1 to receive power from the electrical outlet 1. A transceiver 40 is positioned in the case 36 and is in electrical communication with the microprocessor 38. The transceiver 40 receives the indicator signal and actuates the microprocessor 38.

The at least one receiving assembly 34 also includes a switch 42 in electrical communication with the microprocessor 38 and positioned in the case 36. The switch 42 is actuated between a closed condition and an open condition by the microprocessor 38 when the transceiver 40 actuates the microprocessor 38. An at least one accessory outlet 44 is coupled to the case 36 and in electrical communication with the switch 42. The at least one accessory outlet 44 receives a plug of the lamp 2. The switch 42 controls power to the at least one accessory outlet 44 to turn the lamp 2 on and off. An audio emitter 46 is coupled to the case 36 and in electrical communication with microprocessor 38. The audio emitter 46 is actuated by the microprocessor 38 to emit an audible sound when the transceiver 40 actuates the microprocessor 38.

In the case of multiple transmitting assemblies 12, the microprocessor 38 can actuate the switch 42 to create an unique pattern of flashes of the lamp 2 and unique audio tones from the audio emitter 46 to indicate which one the transmitting assemblies 12 is being actuated. Additionally, multiple receiving assemblies 34 may be used at various locations through out a structure to allow multiple lamps 2 to be flashed so that the actuation of the at least one transmitting assembly 12 may be observed from different locations in the structure.

The multiple receiving assemblies 34 may include a main receiving assembly 48 and a pager assembly 50. The main receiving assembly 48 has a mode switch 52 electrically coupled to the microprocessor 38. The mode switch 52 actuates the microprocessor 38 to switch between a silent mode and an all features mode. In the silent mode the main receiving assembly 48 does flash the lamp 2 and does not actuate the audio emitter 46 to emit an audible sound but actuates the transceiver 40 to transmit a pager signal to the pager assembly 50. The pager assembly 50 is worn by a person and upon receipt of the pager signal the pager assembly 50 vibrates to alert the person of activity at the door. Additionally, the pager assembly 50 may be illuminated to provide a visual signal to the person when the pager assembly 50 receives the pager signal. The pager assembly 50 also includes a display 54 to display the time the pager signal was received and which of the transmitting assemblies 12 transmitted the indicator signal to the main receiving assembly 48.

The all features mode allows the main receiving assembly 48 to flash the lamp 2 and actuate the audio emitter 46 to emit the audible signal to alert the person of activity at the door. The main receiving assembly 48 may also have a pair of mode lights 56 being in electrical communication with the microprocessor 38. A first one of the mode lights 56 is illuminated when the mode switch 52 is switched to the silent mode and a second one of the mode lights 56 is illuminated when the mode switch 52 of switched to the all features mode. The main receiving assembly 48 also includes a locator button 58 being electrically coupled to the microprocessor 38. The locator button 58 is actuated to send a locating signal to the pager assembly 50 to actuate the pager assembly 50 to emit an audible locating tone to facilitate location of the pager assembly 50.

Figure 8:
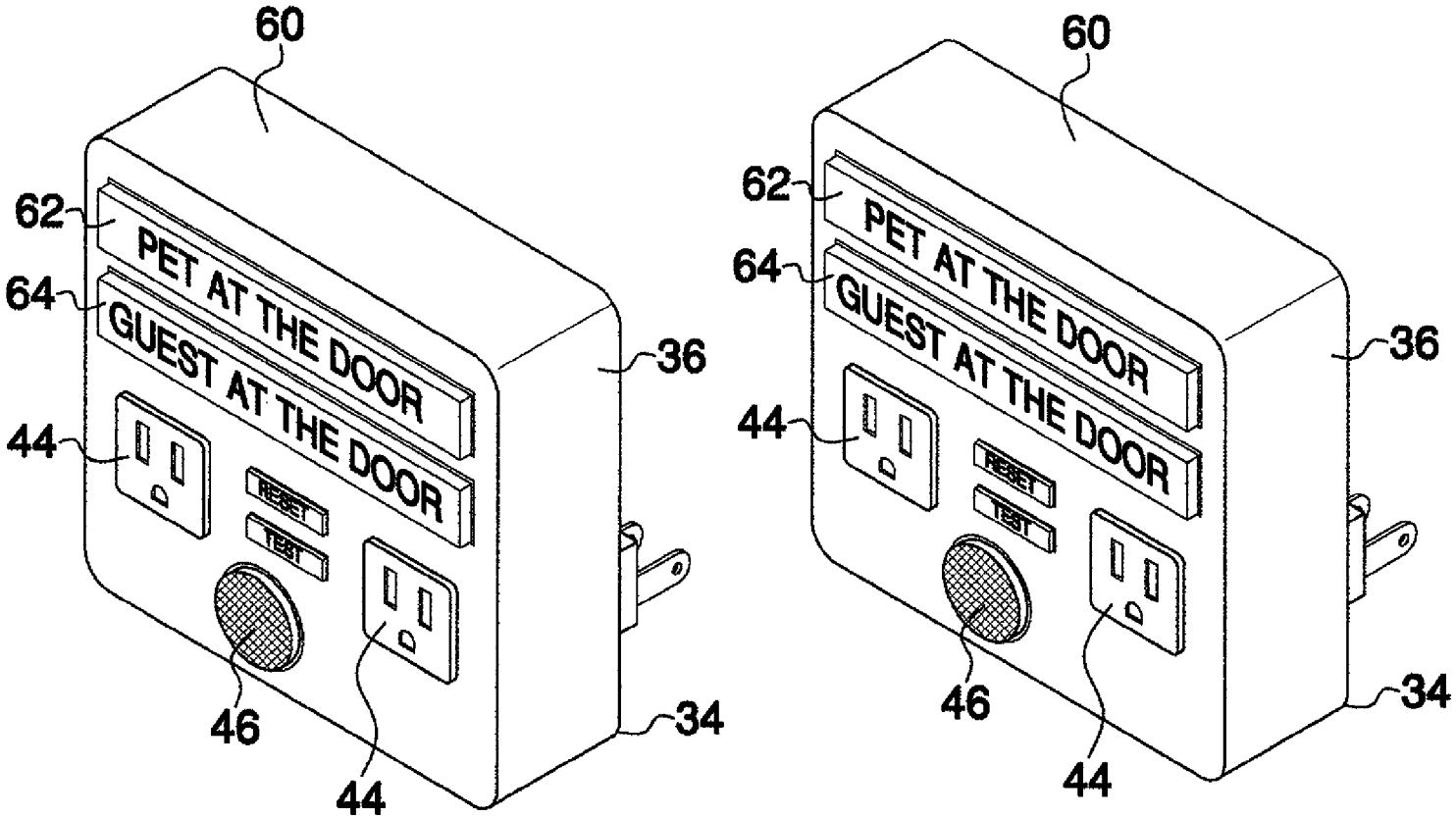
FIG. 8 is a perspective view of the remote receiving assemblies of the present invention.

The multiple receiving assemblies may also include a plurality of remote receiving assemblies 60, as shown in FIG. 8. Each of the remote receiving assemblies 60 receives signals from the main receiving assembly 48 to indicate activity at the door. Additionally, each of the remote receiving assemblies 60 includes a pet light 62 and a mat light 64 being electrically couple to the microprocessor 38 of the associated one of said remote receiving assemblies 60. The pet light 62 is illuminated to indicate the presence of the animal at the door when the main receiving assembly 48 receives the indicator signal from the proximity transmitter 30. The mat light 64 is illuminated when the main receiving assembly 48 receives the indicator signal from the transmitter 28.

In use, the frame 14 is positioned on the support surface adjacent the door where a person or animal must step on the mat 24 when positioned in front of the door. Weight on the mat 24 presses the at least one upper contact strip 26 against the lower contact strip 20 to complete the electrical circuit and actuate the transmitter 28 to transmit the indicator signal. The transceiver 40 of the receiving assembly 34 receives the indicator signal and actuates the microprocessor 38 to flash the lamp 2 and emit the audible sound from the audio emitter 46 to indicate that there is a person or animal positioned outside the door.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A door announcement system for indicating the presence of a person or an animal at a door, said system comprising:

a plurality of transmitting assemblies, each of said transmitting assemblies being actuatable to send an indicator signal;

at least one receiving assembly engaging an electrical outlet to provide power to said at least one receiving assembly, said at least one receiving assembly being in electrical communication with a lamp to turn the lamp on and off when said at least one receiving assembly receives the indicator signal from a transmitting one of said transmitting assemblies;

said at least one receiving assembly including a microprocessor and an audio emitter electrically coupled to said microprocessor, said audio emitter being actuated by said microprocessor to emit an audible sound when said microprocessor receives said indicator signal, said microprocessor actuating said audio emitter to emit in a unique audio tone for each of said transmitting assemblies to indicate which one of said transmitting assemblies has been actuated.

2. The system according to claim 1, wherein said at least one of said transmitting assemblies includes a frame being positioned on a support surface adjacent to the door, said frame having an upper surface having a depression therein.

3. The system according to claim 2, further including a lower contact strip being coupled to said frame, said lower contact strip being positioned in said depression along a bottom face of said depression, said lower contact strip being in electrical communication with a power supply positioned in said frame.

4. The system according to claim 3, further including a mat being coupled to said frame and extending across said depression of said frame, said mat being positioned adjacent to said upper surface of said frame, said mat flexing when weight is applied to said mat, said mat returning to its original configuration when the weight has been removed from said mat.

5. The system according to claim 4, wherein said mat is comprised of a flexible and fluid impermeable material to inhibit liquid entering said depression.

6. The system according to claim 4, further including at least one upper contact strip being coupled to said mat and positioned in said depression of said frame, said at least one upper contact strip being positioned in a spaced relationship to said lower contact strip when said mat is in its original configuration, said at least one upper contact strip being in electrical communication with said power supply, said at least one upper contact strip contacting said lower contact strip when weight is applied to said mat to complete an electrical circuit.

7. The system according to claim 6, further including a transmitter being coupled to said frame, said transmitter being in electrical communication between said lower contact strip and said power supply, said transmitter wirelessly transmitting the indicator signal when said at least one upper contact strip contacts said lower contact strip and completes the electrical circuit.

8. The system according to claim 1, wherein said at least one of said transmitting assemblies includes a proximity transmitter being coupled to a collar positioned around a neck of an animal, said proximity transmitter transmitting the indicator signal over a limited range, wherein the indicator signal is received by said at least one receiving assembly when the animal is positioned near the door.

9. The system according to claim 1, wherein said at least one receiving assembly includes a case housing said microprocessor, said microprocessor being in electrical communication with the electrical outlet to receive power from the electrical outlet.

10. The system according to claim 9, wherein said at least one receiving assembly includes a transceiver being positioned in said case and being in electrical communication with said microprocessor, said transceiver receiving the indicator signal and actuating said microprocessor.

11. The system according to claim 10, wherein said at least one receiving assembly includes a switch being in electrical communication with said microprocessor and being positioned in said case, said switch being actuated between a closed condition and an open condition by said microprocessor when said microprocessor is actuated by said transceiver.

12. The system according to claim 11, wherein said at least one receiving assembly includes an at least one accessory outlet being coupled to said case and in electrical communication with said switch, said at least one accessory outlet receiving a plug of the lamp, said switch controlling power to said at least one accessory outlet to turn the lamp on and off.

13. The system according to claim 12, wherein said microprocessor opens and closes said switch in a unique pattern for each of said transmitting assemblies to indicate which one of said transmitting assemblies has been actuated.

14. A door announcement system for indicating the presence of a person or an animal at a door, said system comprising:

a plurality of transmitting assemblies sending an indicator signal when at least one of said transmitting assemblies is actuated, each of said transmitting assemblies comprising;

a frame being positioned on a support surface adjacent to the door, said frame having an upper surface having a depression therein;

a lower contact strip being coupled to said frame, said lower contact strip being positioned in said depression along a bottom face of said depression, said lower contact strip being in electrical communication with a power supply positioned in said frame;

a mat being coupled to said frame and extending across said depression of said frame, said mat being positioned adjacent to said upper surface of said frame, said mat being comprised of a flexible and fluid impermeable material to inhibit liquid entering said depression, said mat flexing when weight is applied to said mat, said mat returning to its original configuration when the weight has been removed from said mat;

at least one upper contact strip being coupled to said mat and positioned in said depression of said frame, said at least one upper contact strip being positioned in a spaced relationship to said lower contact strip when said mat is in its original configuration, said at least one upper contact strip being in electrical communication with said power supply, said at least one upper contact strip contacting said lower contact strip when weight is applied to said mat to complete an electrical circuit;

a transmitter being coupled to said frame, said transmitter being in electrical communication between said lower contact strip and said power supply, said transmitter wirelessly transmitting the indicator signal when said at least one upper contact strip contacts said lower contact strip and completes the electrical circuit;

at least one receiving assembly engaging an electrical outlet to provide power to said at least one receiving assembly, said at least one receiving assembly being in electrical communication with a lamp to turn the lamp on and off when said at least one receiving assembly receives the indicator signal, said at least one receiving assembly comprising;

a case housing a microprocessor, said microprocessor being in electrical communication with the electrical outlet to receive power from the electrical outlet;

a transceiver being positioned in said case and being in electrical communication with said microprocessor, said transceiver receiving the indicator signal and actuating said microprocessor;

a switch being in electrical communication with said microprocessor and being positioned in said case, said switch being actuated between a closed condition and an open condition by said microprocessor when said microprocessor is actuated by said transceiver;

an at least one accessory outlet being coupled to said case and in electrical communication with said switch, said at least one accessory outlet receiving a plug of the lamp, said switch controlling power to said at least one accessory outlet to turn the lamp on and off; and an audio emitter being coupled to said case and in electrical communication with microprocessor, said audio emitter being actuated by said microprocessor to emit a unique audible sound for each of said transmitting assemblies to indicate which one of said transmitting assemblies has been actuated when said microprocessor is actuated by said transceiver.

* * * * *